United States Patent [19]

Ngo

[11] 4,429,256

[45] Jan. 31, 1984

[54] SELECTIVE SHIFTING AC PLASMA PANEL

[75] Inventor: Peter D. T. Ngo, Colts Neck, N.J.

[73] Assignee: Bell Telephone Laboratories, Incorporated, Murray Hill, N.J.

[21] Appl. No.: 307,169

[22] Filed: Sep. 30, 1981

[51] Int. Cl.[3] ..... H05B 41/14

[52] U.S. Cl. ..... 315/169.4; 340/768; 340/713

[58] Field of Search ..... 315/169.2, 169.4; 340/713, 768, 792, 798

[56] References Cited

U.S. PATENT DOCUMENTS

| | | | |
|---|---|---|---|
| 4,009,415 | 2/1977 | Ngo | 340/714 |
| 4,030,091 | 6/1977 | Ngo | 340/798 X |
| 4,097,780 | 6/1978 | Ngo | 340/805 X |
| 4,104,626 | 8/1978 | Ngo | 340/768 |
| 4,247,802 | 1/1981 | Kurokawa | 315/169.2 |

FOREIGN PATENT DOCUMENTS

| | | | |
|---|---|---|---|
| 3886 | 9/1979 | European Pat. Off. | 340/768 |

*Primary Examiner*—Eugene R. LaRoche
*Attorney, Agent, or Firm*—David H. Tannenbaum

[57] ABSTRACT

An ac plasma panel is arranged with selective row and column shifting capability. Shifting in both the horizontal and vertical directions is accomplished by arranging for display site discharge transportation under control of eight control conductors with four conductors serving the horizontal direction and four conductors serving the vertical direction. The eight control conductors are used to provide sustain pulses for the ON display sites, and, using the same conductors, an out-of-phase pulse is used to freeze any of the display sites in any row or column while allowing display site transfer to occur selectively in any other row or column.

16 Claims, 23 Drawing Figures

| FIG. 1 | FIG. 2 |
|---|---|

FIG. 7 (UPWARD SHIFTING)

FIG. 22

LATERAL STAGING

| PHASE TRANSPORT | GROUPS / INTERVALS | $\phi$1v | $\phi$2v | $\phi$3v | $\phi$4v | A2 | | $\phi$1R | $\phi$2R | $\phi$3R | $\phi$4R | SR2 TO SR14 |
|---|---|---|---|---|---|---|---|---|---|---|---|---|
| 1-2 | a | X,E,Cc | P,SW | NW | | | | PSr, BLr, Rr, SWr, NSr, Er | PSr, Rr, SWr, NSr | PSr, BLr, Rr, SWr, NSr, Er | PSr, Rr, SWr, NSr | |
| 3-4 | b | | Nc,Cc | X,E,C | P,SW | CWc | | | | | | (IF DATA PRESENT) CWr |
| 2-3 | c | | X,E,Cc | P,SW | NW | | | | | | | |
| 4-1 | d | P,SW | | Nc,Cc | X,E,Cc | X,E,Cc | | | | | | |
| 3-4 | e | NW | | X,E,Cc | P,SW | CWc | | | | | | (IF DATA PRESENT) CWr |
| 1-2 | f | X,E,Cc | P,SW | | Nc,Cc | | | | | | | |
| 1-4 | g | P,SW | NW | | X,E,Cc | X,E,Cc | | | | | | |
| 2-3 | h | Nc,Cc | X,E,Cc | P,SW | | | | | | | | |
| 1-2 | a | X,E,Cc | P,SW | NW | | | | | | | | |
| | INITIAL CORRESPONDENCE | ODD DISPLAY | ODD TRANSFER | EVEN DISPLAY | EVEN TRANSFER | | | | | | | |

FIG. 23

UPWARD SHIFTING

| PHASE TRANSFER | GROUPS / INTERVALS | | φ1c | φ2c | φ3c | φ4c | A2 | | φ1R | φ2R | φ3R | φ4R | SR1 TO SR4 |
|---|---|---|---|---|---|---|---|---|---|---|---|---|---|
| 1-2 | a | | PSr, Rr, SWr, NSr | | PSr, Rr, SWr, NSr | | | | X,E,Cc | P,SW | NW | | |
| 3-4 | b | | ↓ | | ↓ | | | | | Nc, Cc | X,E,C | P,SW | |
| 2-3 | c | | ↓ | | ↓ | | | | | X,E,Cc | P,SW | NW | |
| 4-1 | d | | ↓ | | ↓ | | | | P,SW | | Nc,Cc | X,E,Cc | |
| 3-4 | e | | ↓ | | ↓ | | | | NW | | X,E,Cc | P,SW | |
| 1-2 | f | | ↓ | | ↓ | | | | X,E,Cc | P,SW | | Nc,Cc | |
| 1-4 | g | | ↓ | | ↓ | | | | P,SW | NW | | X,E,Cc | |
| 2-3 | h | | ↓ | | ↓ | | | | Nc,Cc | X,E,Cc | P,SW | | |
| 1-2 | a | | ↓ | | ↓ | | | | X,E,Cc | P,SW | NW | | |
| | INITIAL CORRESPONDENCE | | | | | | | | ODD DISPLAY | ODD TRANSFER | EVEN DISPLAY | EVEN TRANSFER | |

SELECTIVE SHIFTING AC PLASMA PANEL

BACKGROUND OF THE INVENTION

My invention is directed to an improved ac plasma display and more particularly to such a display having selective horizontal and vertical shifting capability.

A plasma panel is a display device comprised of a body of ionizable gas sealed within a nonconductive, transparent envelope. Alphanumerics, pictures, and other graphical data are displayed by controllably initiating glow discharges (also referred to as "gas discharges") at selected locations (sites) within the display gas. This is accomplished by setting up electric fields within the gas via appropriately arranged electrodes, or conductors.

The invention principally relates to so-called twin-substrate ac plasma panels which have the conductors embedded within dielectric layers disposed on two opposing nonconductive surfaces, such as glass plates. Typically, the conductors are arranged in rows on one plate and columns orthogonal thereto on the other plate. The overlappings, or crosspoints, of the row and column conductors define a matrix of discharge cells, or sites. Glow discharges (the ON-site condition) are initiated at selected crosspoints under the control of, for example, a digital computer.

My priorly filed copending patent application, known as Ser. No. 109,859, filed Jan. 7, 1980, now Pat. No. 4,328,489, is directed, inter alia, to a technique for providing self-shifting of the ON display sites of an ac plasma panel. In that application lateral shifting is accomplished using a four-phase technique operating in a manner to cause display site discharge transportation from an ON display site to a next adjacent site position. Using the four-phase technique, it is possible to connect together each fourth column conductor, resulting in the use of only four column drivers as opposed to one driver for each column conductor.

While my priorly taught technique operates properly, there still is required a separate driver for each of the row conductors. These individual drivers are necessary for the establishment of the visual display patterns, with each pattern typically consisting of a 13-row by 9-column matrix. Assuming a display having capability of 39 character lines, then 507 row conductors, each requiring driver circuitry, are necessary.

A major problem encountered in reducing this large number of row drivers stems from the fact that a display having four column drivers and only four row drivers would not have the capability of selectively introducing plasma discharge patterns to produce the desired intelligence on the display screen.

In an attempt to solve this problem, attention is directed to the establishment on one portion of the display, such as for example, along the bottom of the display, a staging area for the introduction onto the display of the desired information. Using this arrangement, the staging area would consist of several display rows and information in the form of discharge patterns would be introduced, as for example, in my prior invention, from the right side of the display. The introduced ON sites would then be shifted laterally across the display from site to site using the four-phase shifting technique. Once the information is in the desired lateral position within the staging area, the ON site would then be shifted upward to the proper display area for visual presentation to a viewer.

While, in theory, this approach solves the data introduction problem, it creates another problem which must be solved before the arrangement is practical. Because plasma panel row and column conductors are continuous, each column conductor of the lower staging area also extends through the upper display area. Thus, voltage pulses which are applied to the column conductors in the staging area for the purpose of lateral ON-site transportation will also be applied to the entire display column. Consequently, not only will information be shifted across the staging area, but any priorly displayed information within the viewing area will also be laterally shifted, thereby defeating the purpose of the staging area.

SUMMARY OF THE INVENTION

I have achieved selective display site propagation on an ac plasma panel by modifying the conductor voltage pulses wich control the lateral four-phase transportation of ON sites. As discussed in my above-identified priorly filed copending patent application, each ON site must be refreshed on a periodic basis by a voltage pulse having a polarity, as measured across the row and column conductors at the intersecting site. This refresh pulse reverses the electric field across the priorly discharged gas at that site. This reversal of electric field causes an electron migration (charge cloud) across the display at each ON site. Lateral shifting is accomplished by establishing another (transportation) electric field between an ON site (called the display site) and an adjacent site (called the transfer site) during the electron migration interval. The migrating charge cloud provides electrons for priming the transfer site thereby allowing the transfer site to become a new ON site under control of the transfer pulse.

I have discovered that when the refresh electrical pulse is applied more than a given time before the establishment of the transportation field, the polarity changes and the charge cloud "settles down" and is not available to perform the priming function. Thus, the transportation field wll have no effect and the transfer site will remain off.

Using this concept, I have designed a plasma panel display with a lower staging area and an upper viewing area with both areas sharing common vertical conductors. The staging area has a row driver for each possible ON site while the viewing area shares four row drivers multiplexed in the priorly discussed four-phase shifting arrangement. These row drivers are used to shift data upward from the staging area to the viewing area as well as to refresh existing ON sites. When data has been positioned within the viewing area, it will be maintained in position by the application of sustaining fields applied between the column and row conductors.

Data, in the form of glow discharge patterns (ON sites), is presented to the staging area and shifted into position from right to left using the four-phase transportation technique whereby an electric field at each ON site causes an electron cloud to migrate across the discharge space. A second electric field is created between the original site and a next adjacent site causing lateral shifting of the electrons to that next site.

In order to avoid lateral shifting of ON sites in the upper viewing area, I apply an early electric field to the viewing area sites causing premature charge cloud migration across the ON sites. The timing of this premature electric field is such that the resulting charge cloud migration is substantially complete prior to the time when the lateral transportation electric field is established. Accordingly, when the transportation field is applied to the adjacent column conductors, only those ON sites in the staging area (which have not received the premature electric field) have electrons available for priming the transfer site. In this manner it is possible to selectively control the plasma display such that a portion of the display may be shifted while another portion is frozen in place.

BRIEF DESCRIPTION OF THE DRAWING

In the drawing

FIGS. 22 and 23 are charts showing the sequence in which the voltage pulses are impressed across the discharge sites.

DETAILED DESCRIPTION

Figure 1:
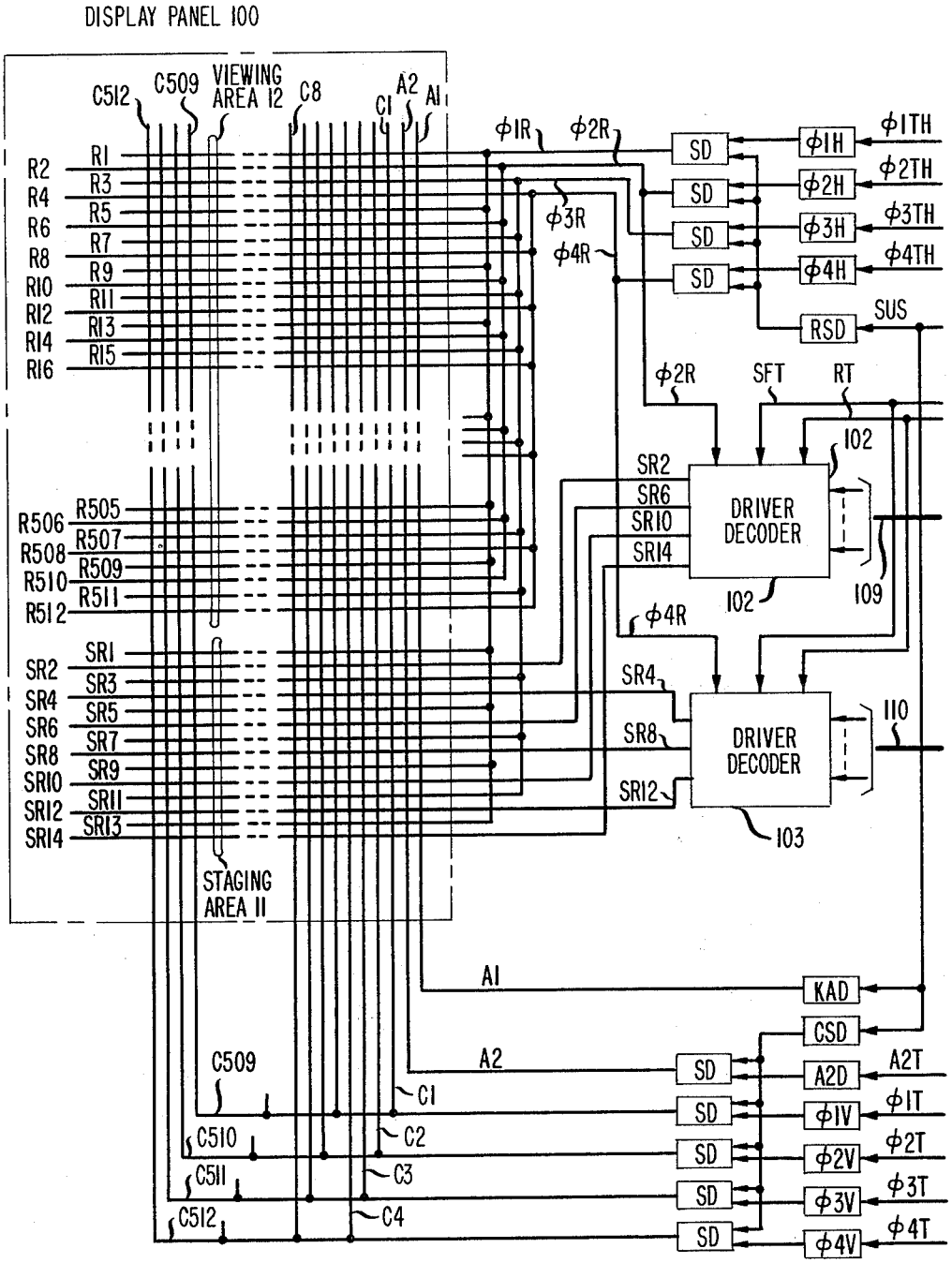
FIGS. 1 and 2 depict an ac plasma display system which includes circuitry for implementing the selective shifting technique of the present invention.
Figures 2, 3:
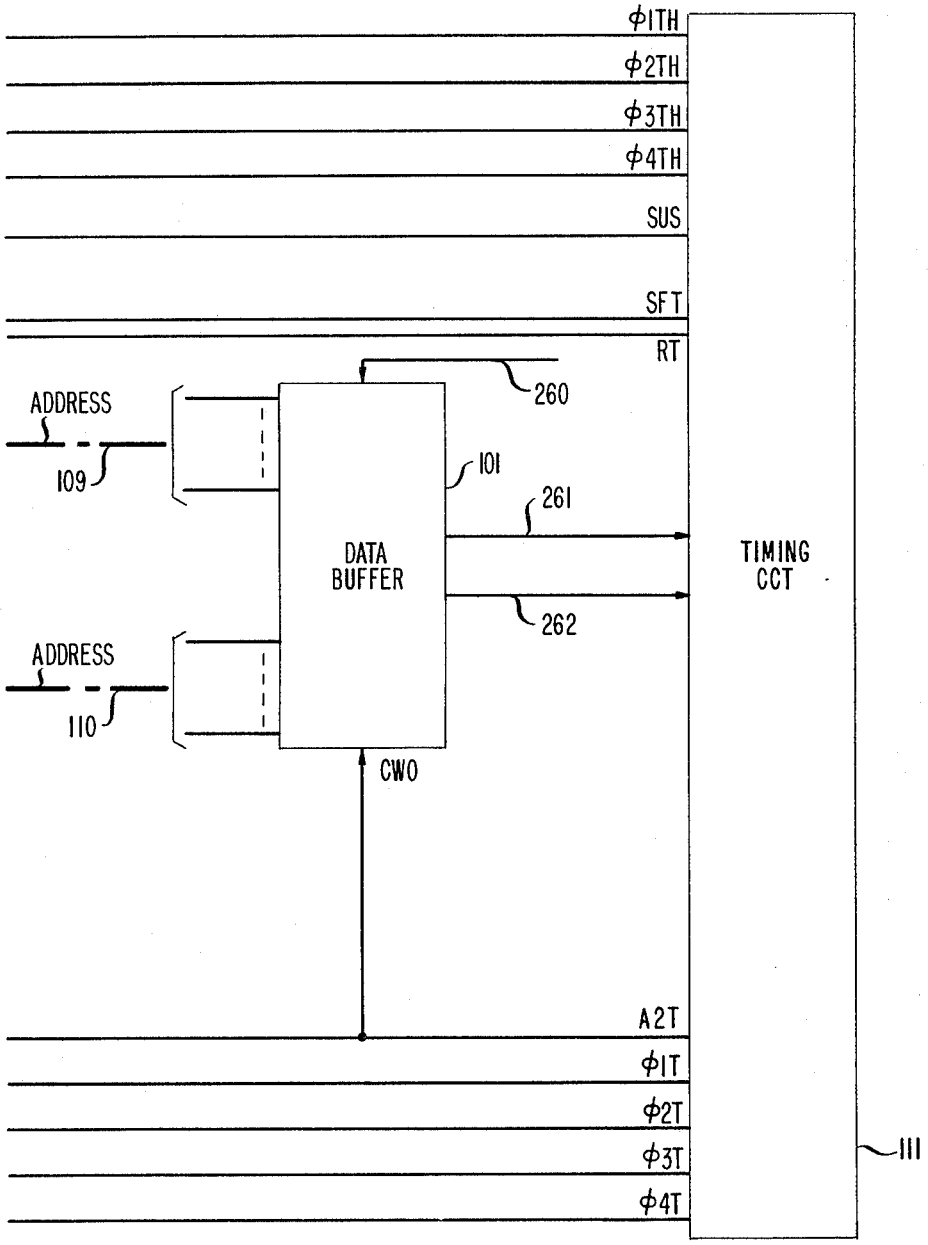
FIG. 3 shows how FIGS. 1 and 2 should be arranged.

At the heart of the display system of FIGS. 1 and 2 is a twin-substrate ac plasma display panel 100. Panel 100 is illustratively comprised of two glass plates between which an ionizable gas mixture is sealed. The inner surface of each glass plate is covered by a dielectric layer. A first set of 512 column conductors, C1-C512, is embedded in one of the dielectric layers in a generally vertical direction. A second set of 512 row conductors, R1-R512, is embedded in the dielectric layer in a generally horizontal direction. These conductors combine with the column conductors to form sites of viewing area 12. A third set of row conductors, for convenience called the staging row conductors, SR1-SR14, are embedded in the bottom section of the display in the same dielectric layer as are row conductors R1-R512. These staging row conductors are in the horizontal direction and combine with the column conductors to form sites of staging area 11.

The staging area may be placed anywhere on the panel, within or outside of the viewing area and may be arranged to operate left to right or right to left. In other embodiments there may be several independent staging areas, some of which may be used for storage of data scrolled off the viewing area. Such an arrangment would be useful for, by way of example, forward and reverse scrolling.

The conductors of each set are spaced at, for example, 60 lines per inch. The individual regions of panel 100 defined by the overlappings, or crosspoints, of the various row and column conductors are referred to as discharge sites. Visual data are presented on the panel by creating glow discharges in the gas at selected crosspoints. Panel 100 is illustratively of the general type disclosed in U.S. Pat. No. 3,823,394 issued July 9, 1974, to B. W. Byrum et al, which is hereby incorporated by reference.

Most ac plasma panel systems use conventional write and erase pulses to switch OFF sites to the ON state and vice versa. The following discussion of the characteristics and operation of such pulses wll be found helpful in understanding some of the basic principles of ac plasma panel operation.

Figure 4:
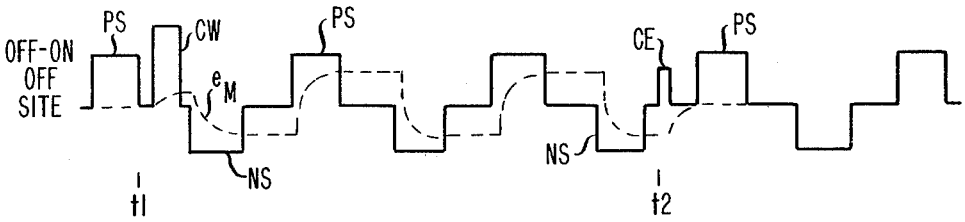
FIG. 4 depicts a signal waveform comprised of conventional ac plasma panel write, erase and sustain pulses.

FIG. 4 depicts a typical conventional write pulse CW. This pulse, shown as beginning at a time $t_1$, is impressed across (applied to) a selected discharge site of an ac plasma panel via the row and column conductor pair associated with that site. The magnitude of pulse CW exceeds the breakdown voltage of the display gas and is thus sufficient to create an initial glow discharge in the gas in the immediate vicinity of the selected site. The glow discharge is characterized by (a) a short, e.g., one microsecond, light pulse in the visible spectrum, and (b) the creation of a plasma, or "space charge cloud," of electrons and positive ions in the vicinity of the site. Pulse CW pulls at least some of these so-called charge carries to opposite walls of the discharge site, i.e., respective regions of the opposing dielectric surfaces near the crosspoint. Even when pulse CW terminates, a "wall" voltage $e_M$ remains stored across the gas in the cross-point region. This wall voltage plays an important role in the subsequent operation of the panel, as will be seen shortly.

A single short duration light pulse cannot, of course, be detected by the human eye. In order to provide a discharge site of an ac plasma panel with the appearance of being continuously light-emitting (ON, energized), further rapidly successive glow discharges and accompanying light pulses are needed. These are generated by sustain signals, PS, NS, which are impressed across each site of the panel via the conductor pairs. As indicated in waveform A, the sustain signals are illustratively comprised of a train of alternating positive-polarity and negative-polarity sustain pulses, PS and NS, respectively. The magnitude of these sustain pulses is less than the breakdown voltage. Thus, the voltage across display sites not previously energized by a write pulse is insufficient to cause a discharge and those sites remain non-light-emitting.

However, the voltage across the gas of a previously energized discharge site comprises the superposition of the sustain signal with the wall voltage $e_M$ previously stored at that site. In particular, the wall voltage created by write pulse CW, for example, combines additively with the following negative sustain pulse NS. This combined voltage exceeds the breakdown voltage so that a second glow discharge and accompanying light pulse occur. The flow of carriers to the walls of the discharge site now establishes a wall voltage of negative polarity. Thus, the following positive sustain pulse PS creates another discharge and wall voltage reversal, and so forth.

As long as at least a particular minimum level of wall charge is stored in response to each of these initial sustain pulses, the wall charge level, and hence the magnitude of wall voltage $e_M$ will build up to a constant, steady-state characteristic level. The sustain signal frequency is typically on the order of 40–50 kHz. Thus, the light pulses created in response to each sustain pulse are fused by the eye of the viewer and the site appears to be continuously light-emitting.

A plasma discharge site already in a light-emitting state is switched to a non-light-emitting (OFF, de-energized) state by removing its wall charge. This is accomplished by an erase pulse, such as conventional erase pulse CE, which begins at a time $t_2$. Again, this pulse is impressed across a particular site by way of its row and column conductor pair. Since positive pulse CE follows a negative sustain pulse NS, pulse CE causes a discharge at an ON site, just as a positive sustain pulse would have. Wall voltage $e_M$ begins to reverse polarity. However, erase pulse CE is of such short duration relative to a sustain pulse that the wall voltage reversal is terminated prematurely. In particular, it is terminated at a time when the wall voltage is less than the minimum necessary to foster further discharges. The discharge site is thus returned to a non-light-emitting state. Any residuum of wall voltage $e_M$ eventually disappears due to recombination of the positive and negative charge carriers and diffusion thereof away from the display site.

Figure 5:
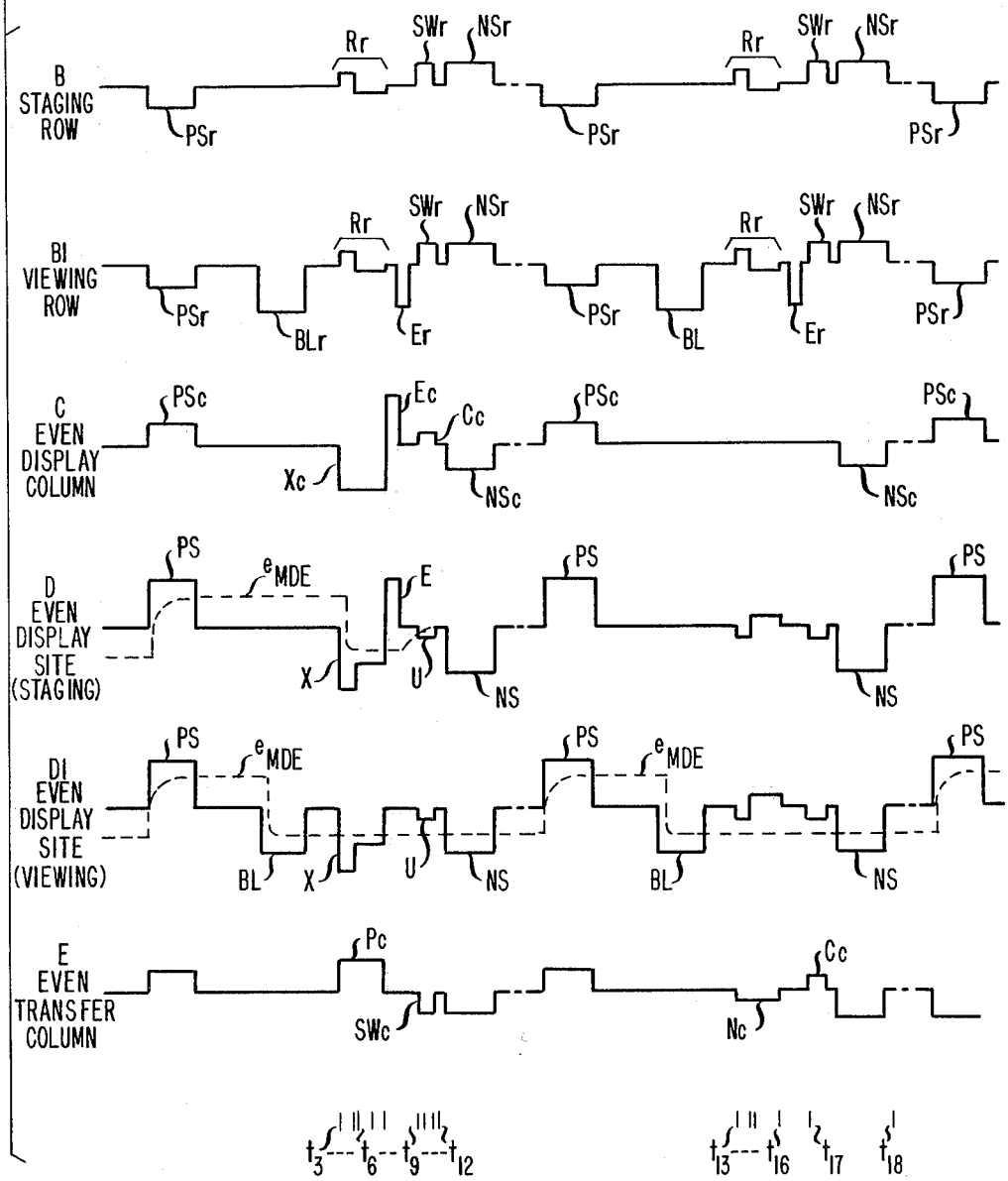
FIGS. 5, 6 and 7 depict several signal waveforms comprised of pulses used in the display system to provide selective shift capability in accordance with the invention.
Figure 6:
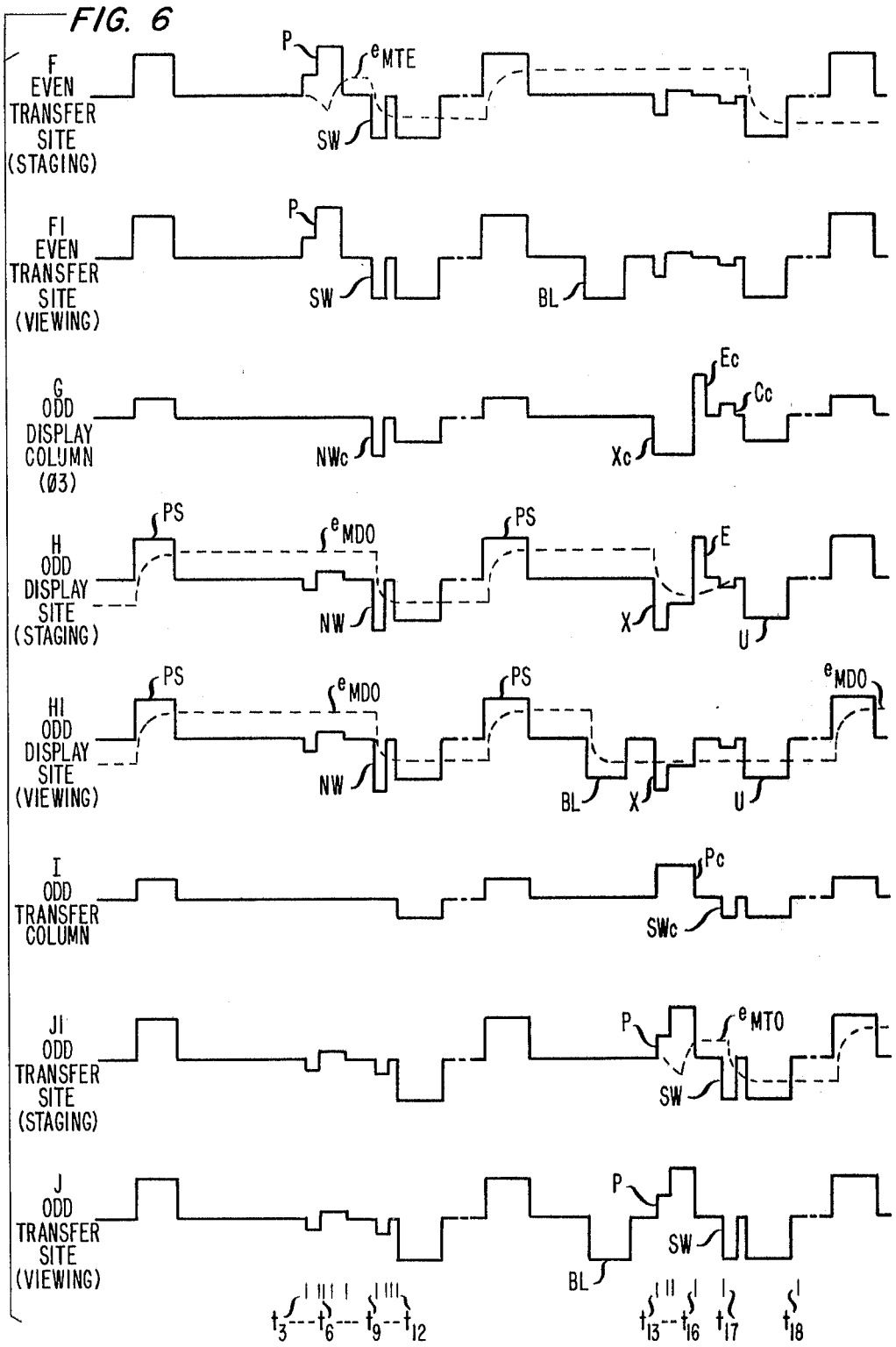

The shifting of information across panel 100 is achieved in accordance with the self-shift technique taught in my above-identified copending patent application, which is hereby incorporated by reference, by applying the signals shown in waveforms B-J of FIGS. 4 and 6 to the sites of the panel in accordance with the sequence of FIG. 22. Before these signals are described, however, an overview of the self-shift process which they implement will be presented with reference to FIGS. 5–8. During the discussion of the shifting technique, it should be kept in mind that it is desired to only shift the information on a portion of the ac panel, while maintaining any information priorly positioned at another location of the panel in the same position. As discussed hereinbefore, unless some affirmative action were to be taken, all of the information on the panel would be shifted to the left when new information is placed on the panel. This result follows from the fact that the vertical transport columns (C1-C512, FIG. 1) extend through both upper viewing area 12 and lower staging area 11 of the panel. As will be seen, this affirmative action is accomplished by a premature electric field applied to the sites of the upper portion of the panel. The premature signal, as will be seen, is applied between column conductors C1-C512 and the odd one of viewing area row conductors R1-R511. This electric field serves to freeze the upper portion of the panel for continuous viewing while information is shifted into the staging portion.

At any point in time, information is displayed on the panel via the energization of selected sites in alternate columns and rows of the plasma panel. The columns and rows in which information is being displayed at any point in time are referred to as "display sites".

This format is illustrated in FIGS. 8–17 which depict a portion of the display panel. By way of example, the characters "A", "B", "C" and "D" are presented for viewing. The staging area is blank. The characters "S" and "P" will be shifted in from right to left and are shown in each of FIGS. 9–17 in successive points in the shifting process. The individual sites are selectively energized during either phase 2 or phase 4 via driver decoders 102 and 103 only from data provided by data buffer 101. The purpose of using only these two phases, and not phase 1 or phase 3 will become clear hereinafter. At this point it is sufficient to understand that ON sites will be created by the coincidence of a voltage pulse on a column conductor C1-C512 and a row conductor SR1-SR14. The sites in the column defined by conductor A1 are conventional, always-ON, keep-alive sites. These need not be discussed in further detail except to note that in practice, there are typically several lines of keep-alive sites on each side of the panel rather than the one line of keep-alive sites shown in FIGS. 8-17.

Figure 12:
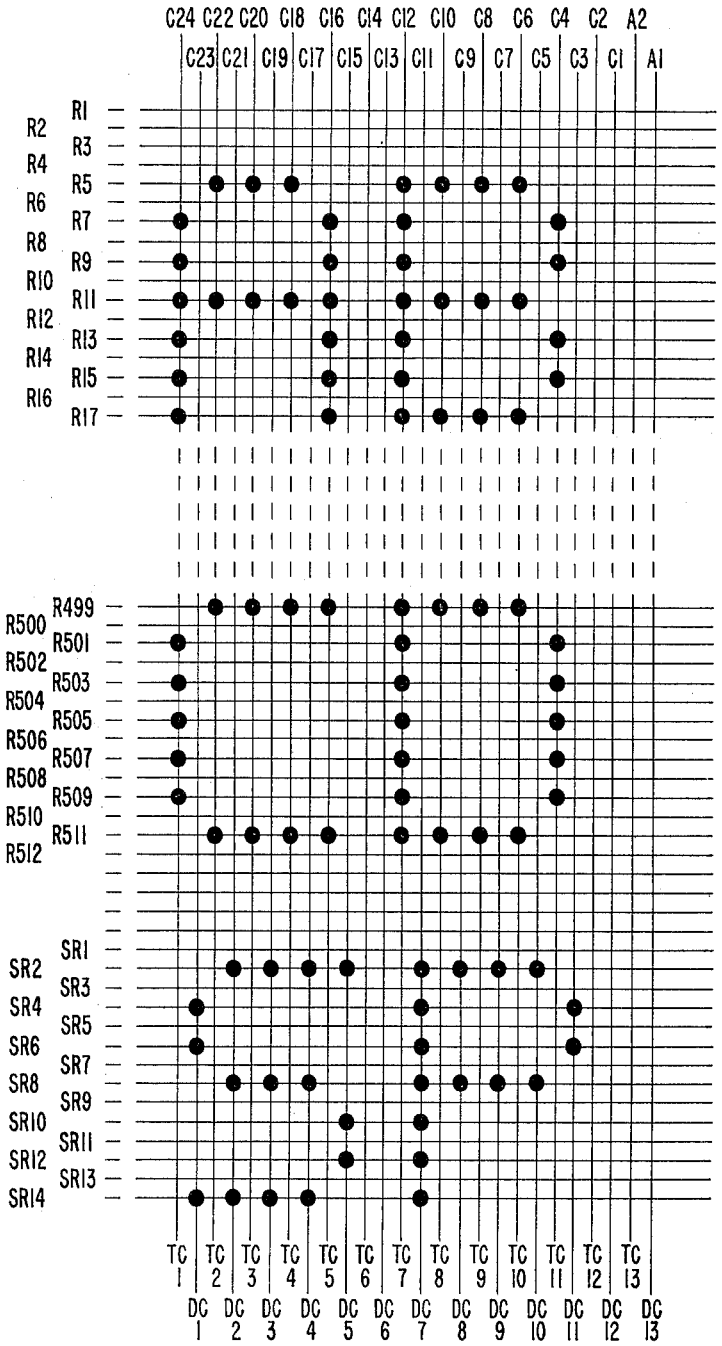

It is convenient to assign reference characters not only to the spatially fixed column conductors of the panel, i.e., C1-C512, but also to the spatially non-fixed columns of the displayed image. In particular, the cloumn of display sites in which the ON sites reside at any fixed interval of time area called, for convenience, display sites and are designated DC-. Thus, as shown in FIG. 12 the left-most portion of the character "S" resides in column C23 which is designated DC1 for discussion purposes. The transfer column (column C24) to its left is designated TC1. The display and transfer columns to the immediate right of column DC1 are respectively designated DC2 and TC2, and so forth. Since these designations refer to columns in the displayed image (as opposed to the fixed column conductors), the character "S", for example, always appears in columns DC1-DC5, even though it appears at different ones of the column conductors C1-C512 as the "S" is shifted across the panel. This shifting process is depicted in FIGS. 9–12 where the "S" and "P" are laterally shifted across the staging area while the priorly positioned "A", "B", "C" and "D" are maintained in a fixed position within the designated viewing area.

It will be noticed that only alternate columns and rows are used to carry displayed information. This format is not a requirement or limitation of the present invention, but is employed in this embodiment to provide a pleasing aspect ratio for the displayed characters.

Figure 13:
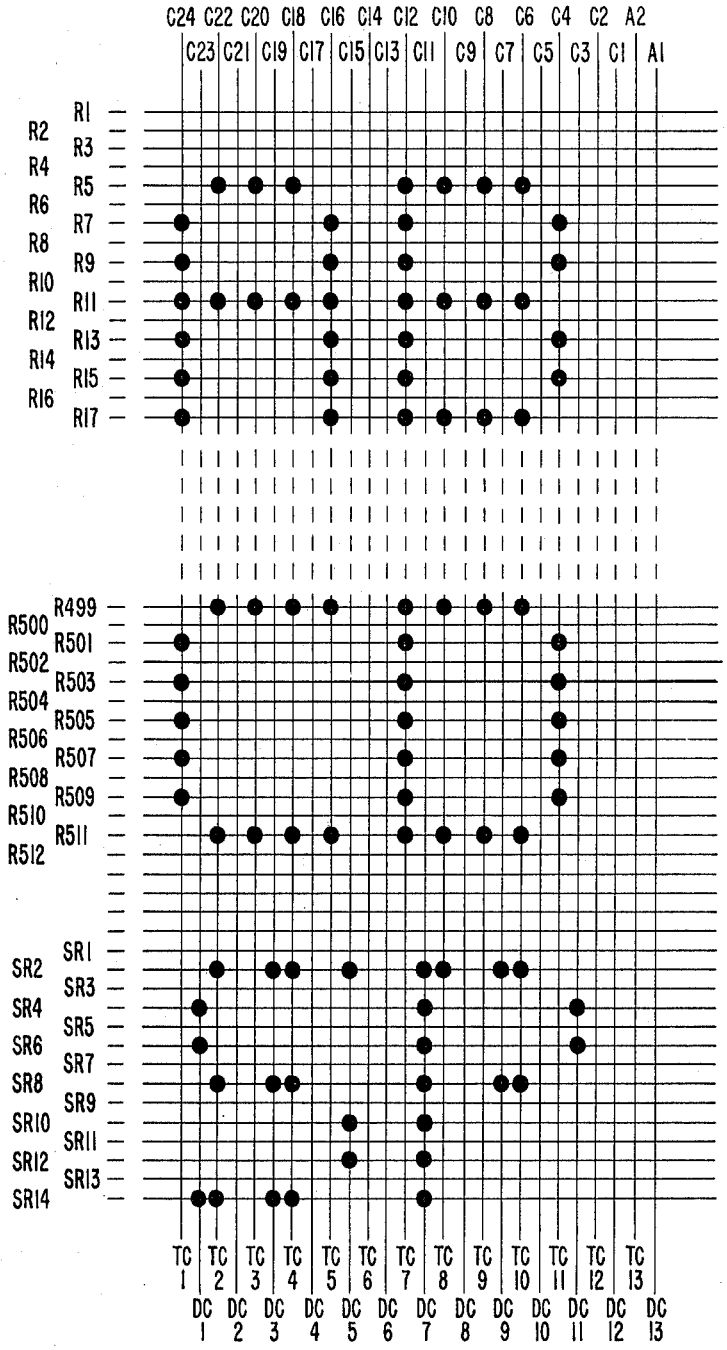
Figure 14:
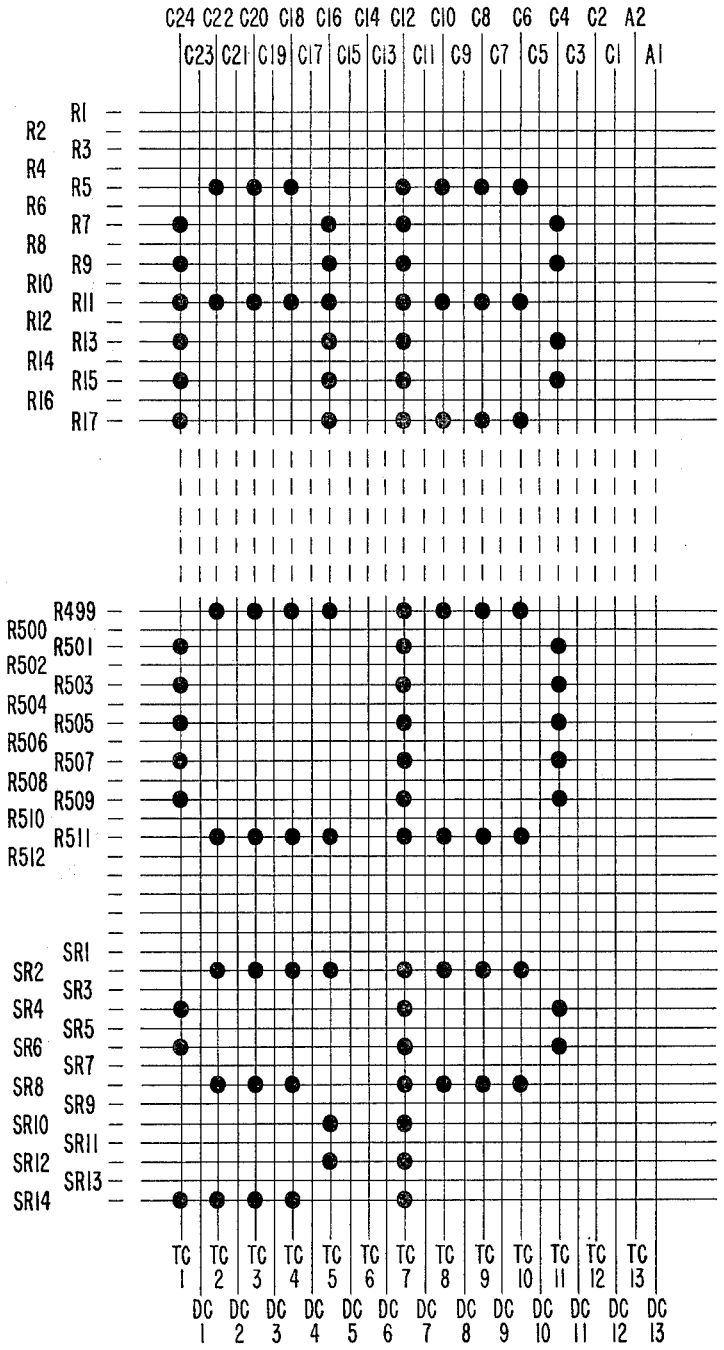

As detailed in my above-identified copending patent application and as reviewed below, the characters on panel 100 are shifted one column to the left in a two-step process. In the first step, the states of the sites in one of the sets of display columns—illustratively the even display columns DC2, DC4, etc., of FIG. 12 are shifted along their respective rows to the sites in the even transfer columns TC2, TC4, etc. The resulting pattern of On sites is shown in FIG. 13. The states of the sites in the other set of display columns, i.e., the odd display columns DC1, DC3, etc., are then shifted in the second step along their respective rows to the odd transfer columns TC1, TC3, etc. As shown in FIG. 14, this completes the desired one-column shift to the left. The displayed characters may be shifted as far to the left as desired by repeating the two-step process.

The use of the signals in waveforms B-J, FIGS. 5 and 6, to achieve the above-described shifting operation will now be explained with reference to that portion of panel 100 defined by row conductor SR2 and columm conductors C8-C16, shown in FIG 12. FIGS. 18–21 depict a cross-section of this portion of panel 100 at various points in the shifting process. As shown in these FIGS. 18–21, row conductor SR2 is embedded in a dielectric layer 1801 on one side of the body of display gas 1803. Column conductors C8-C16 are embedded in a dielectric layer 1802 on the other side of the display gas. (The width of the gap between dielectric layers 1801 and 1802 is exaggerated for drawing clarity.) The crossover regions of row conductor SR2 with column conductors C8-C16 define nine discharge sites.

Figure 18:
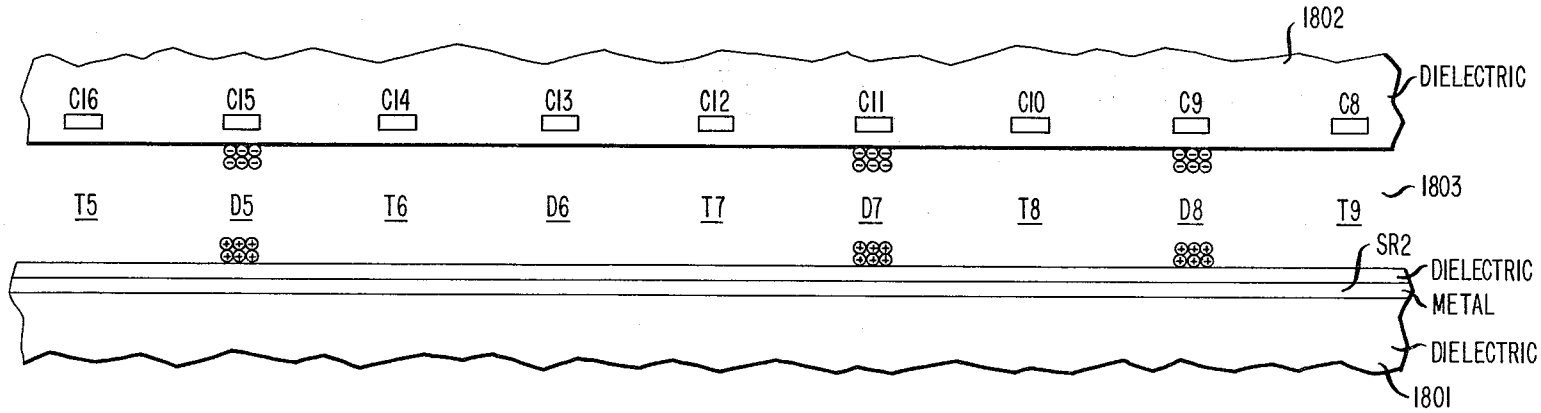
FIGS. 18–21 are cross-sectional views of a portion of the plasma panel used in the display system of the present invention.

FIG. 18 illustratively depicts these sites at the same point in time depicted in FIG. 12. Thus, display (transfer) columns DC5, DC6, DC7 and DC8 (TC5, TC6, TC7, TC8 and TC9) are currently positioned at the column locations defined by column conductors C15, C13, C11 and C9 (C16, C14, C12, C10 and C8), respectively. As indicated in FIG. 12 and in FIGS. 18–21, the corresponding display (transfer) sites are designated D5, D6, D7 and D8 (T5, T6, T7, T8 and T9).

The last sustain pulse applied to panel 100 is assumed to have been positive, voltages being measured from the column conductors to the row conductors. Thus, the negative, electron component of the wall charge stored at each ON site is adjacent to dielectric layer 1802, while the positive, ion component is adjacent to dielectric layer 1801. In conformity with FIG. 12, display sites D5, D7 and D8 are shown in FIG. 18 as being currently in the ON state.

Reference is now made to waveforms B-F of FIG. 5. The shifting of the states of the even display sites to their respective transfer sites begins by impressing an excitation pulse X across the even display sites and concurrently, i.e., in time coincidence, impressing a priming pulse P across the even transfer sites. These pulses begin at time $t_3$ and terminate at time $t_7$. Pulses X and P have a common row component Rr, shown in waveform B. Their column components, Xc and Pc, are shown in waveforms C and E, respectively. Pulses X and P themselves are shown in waveforms D and F, respectively. Waveform D also shows the wall voltage $e_{MDE}$ of ON even display sites.

Figure 20:
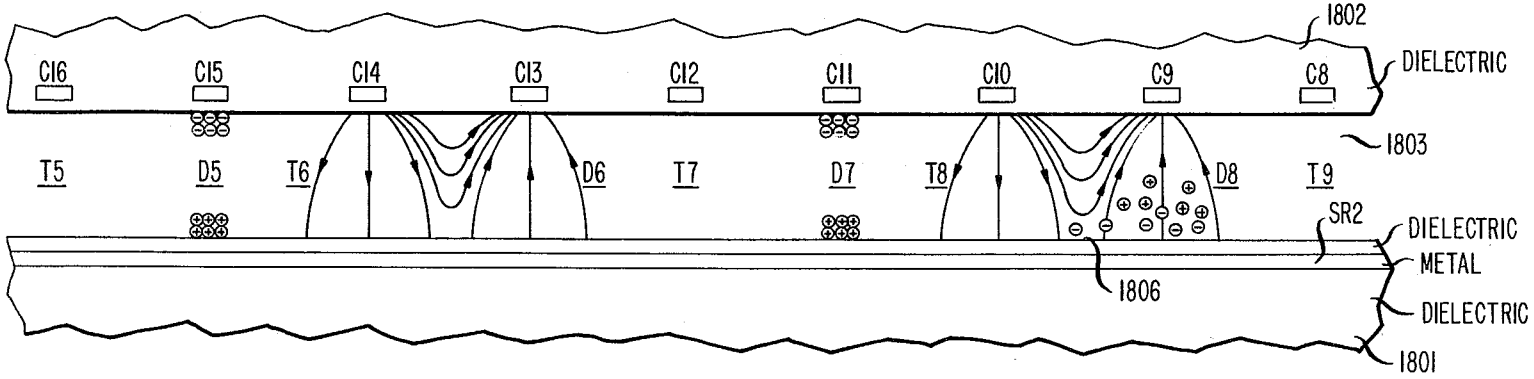

Attention is directed to FIG. 20, which depicts the electric fields and charge distribution at sites T5, D5 . . . T9 at a time $t_4$ just after the onset of pulses X and P. Since pulse X is of negative polarity but has a peak magnitude which is less than the breakdown voltage, it performs much like a negative sustain pulse. That is, it causes a discharge only if wall charge was previously stored at the site to which it is applied, i.e., only if the site is in the ON state. Pulse X thus causes a discharge at even display site D8. since even display site D6 is OFF, however, pulse X causes no discharge thereat.

At the point in time depicted in FIG. 20, the space charge cloud of electrons and positive ions has just formed and the field gradient at display site D8 has begun to draw electrons toward row conductor SR2 and positive ions toward column conductor C9. Many of the electrons have already arrived at or near a surface of dielectric layer 1801. The ions move much more slowly than the electrons since they are of considerably greater mass. Thus, few of them have yet reached the surface of layer 1802. This movement of electrons and ions is the conventional process by which the polarity of the wall voltage at an ON site—in this case, wall voltage $e_{MDE}$ (shown in FIG. 5D) is reversed when the site receives a sustain or sustain-like signal, e.g., pulse X.

The polarity of even transfer column component Pc (illustratively positive in FIG. C) with respect to that of column component Xc (illustratively negative) is such as to create a transverse field gradient from transfer site T8 to display site D8. This causes some of the electrons in the charge cloud at display site D8 to be transported along the surface of layer 1801 toward transfer site T8 to, for example, point 1806.

FIG. 6, waveform F shows that the electrons transported from even display site D8 cause a voltage $e_{MTE}$ to appear at transfer site T8. A portion of this voltage may be due to transported electrons which have not actually reached the wall of transfer site T8. However, those electrons provide the same function as electrons stored at the wall, and $e_{MTE}$ may thus be regarded as a "wall voltage."

Eventually, wall voltage $e_{MTE}$ becomes sufficiently large that, at time $t_6$, its combination with pulse P causes a discharge at transfer site T8. The voltage needed to initiate a discharge at transfer site T8 is lower than that required to initiate a discharge at a site using conventional write pulse CW, for example. This is because transfer site T8 has a wall voltage $e_{MTE}$ and has been primed with photoelectrons by the discharge which just occurred (within 1 μs) at display site D8. Transfer site T8 is thus switched to the ON state. Note that had the display site D8 discharge occurred earlier then transfer site T8 would not have been primed and would not have switched to the ON state unless a higher voltage (on the order of 120 volts) was applied. This situation will be discussed more fully thereinafter.

Since, as shown in FIG. 20, pulse X causes no discharge at display site D6, however, no electrons are transported to transfer site T6. The latter thus remains OFF.

It should now be clear that since all of the ON sites associated with the even column are transported to the left column and since the sites at the upper viewing portion of panel 100 are controlled by the same column conductors, any ON sites in the upper viewing portion of the screen would also shift left one cloumn. Thus, as discussed priorly, the viewing area panel sites must be treated differently from the lower or staging, panel sites. This is accomplished by a blocking pulse which is applied to the row viewing area conductors during the time when it is desired to freeze the upper area of the panel. This negative blocking pulse, shown as BL in waveform D1, FIG. 5, occurs after the positive sustain pulse PS (also shown in waveform D1). The blocking pulse has row component $BL_r$ (waveform B1) which is approximately twice the magnitude of the row sustain pulse component $PS_r$. This magnitude is necessary since the column component is zero (waveform C).

It can be seen from waveform D1 that the site wall voltage $e_{MDE}$ goes negative in response to the blocking pulse and remains negative until the next positive sustain pulse, with the intermediate negative sustain pulse NS having no effect.

Figure 19:
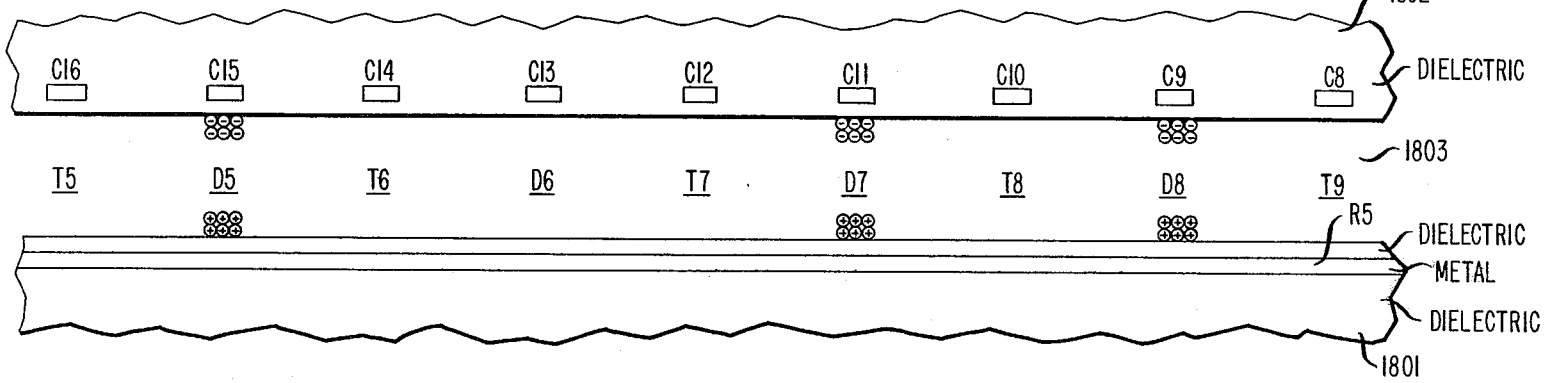
Figure 21:
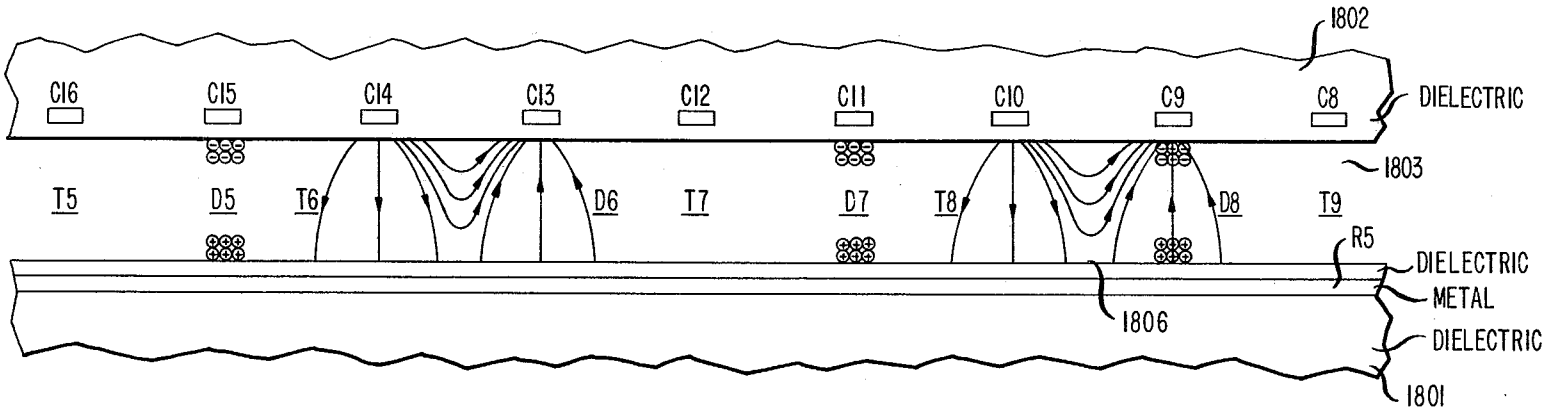

The effect of the blocking pulse can be seen in FIG. 19 where, as a result of blocking pulse BL being applied on a viewing area row, such as on row R5, all of the priorly ON sites remain in the ON state, however, the wall voltage of the even display column D8 has been reversed. (Note that the charges shown in FIG. 19 are shown to illustrate the invention and do not actually correspond to the ON sites of FIG. 12.) The blocking pulse is applied sufficiently prior to the transport X pulse so that the charge cloud actually settles before the onset of the X pulse and thus the electrons and ions are consolidated around the conductor of display site D8. Thus, as shown in FIG. 21, when the transport field is created by the X voltage pulse, there are no free charge carriers to prime the adjacent transfer site and thus ON-site transportation does not occur. Accordingly, by applying an early blocking pulse to selected rows of the panel, the ON sites associated with those rows are prevented from being transported to adjacent sites. It follows also that by inhibiting the blocking pulse, it is possible to have the entire panel shift concurrently. It should also be noted that the blocking pulse acts as a sustain pulse for the ON sites of the viewing area.

Prior to discussing the actual circuit arrangement for controlling the panel, it is important to understand the transport mechanism for the staging portion of the panel to see how the pulses subsequent to the transport pulse are handled differently for each portion of the screen.

An erase pulse E (waveform D) is impressed across the even display sites of the lower portion of the panel subsequent to the onset of pulse X. Pulse E occurs from time $t_7$ to time $t_8$, i.e., upon the concurrent termination of pulses X and P. Any of the lower panel even display sites which are in the ON state thus switch OFF; any which are OFF remain OFF. The overall effect, then, is that the states of all lower portion even display sites are shifted to the corresponding transfer sites. (It may be possible for pulse X to be so shaped as to erase the ON even display sites, thereby precluding the need of a separate erase pulse.)

Erase pulse E consists of positive column component Ec (waveform C). The staging area row component of the erase pulse (waveform B) is zero while the viewing area row component Er is negative. The negative pulse is required to insure that the erase pulse does not extinguish the ON sites in the viewing area.

The self-shift technique is illustratively carried out in two steps. If excitation pulse X were applied, for example, to odd display site D5 FIG. 18 at the same time as it is applied to even display site D6, charge from the former would be transported to transfer site T6, causing that transfer site to be switched to the ON state even though its associated display site D6 is OFF. Shifting the states of the odd and even display sites at different times precludes this so-called back-shifting phenomenon. This two-step process requires four phases to accomplish.

In order to insure proper operation, pulses other than those discussed above are necessary. The reasons for these other pulses and their relationship is fully discussed in my aforementioned copending patent application and will not be repeated herein.

In an embodiment of the invention, it was found that the time period between pulses E and SW (i.e., from the termination of the former to the onset of the latter) is 1.2 $\mu$s; between pulses SW and NS 0.5 $\mu$s; between pulses PS and NS 15.0 $\mu$s during shifting periods and 5.0 $\mu$s during nonshifting periods. The time period between the end of the pulse BL and the beginning of pulse X is greater than 1 $\mu$s. The width of pulse BL is 5 ms while its magnitude is 100 V.

It should be noted that the SW and NS pulses need not be separated, thus avoiding the canceling pulse NW. In this situation pulse SW can be extended to include pulse NS.

INTRODUCTION OF ON-SITES

New information is introduced onto the panel by selectively energizing sites in a write column, here the column defined by conductor A2. At the point in time depicted in FIG. 9, three sites (901,902,903) of the letter "S" have been written into write column A2. In the present illustrative embodiment, energization of selected sites in the write column is effected by applying conventional write pluse CW on a half-select basis to the sites desired to be switched to the ON state. Pulse CW may have a width of 3.01 $\mu$sec and amplitude of 160 volts equally divided between row and column components CWr and CWc (the timing of these pulses is shown in FIG. 22).

It is anticipated that, as a further alternate, pulses similar to ones shown in FIGS. 5 and 6, waveforms B-J, could be used to "shift in" the ON state of the keep-alive sites, i.e., the sites in the column defined by conductor A1, to selected sites in write column A2. The width and magnitude parameters of such shift-in pulses would have to be adjusted to take account of the unique characteristics, e.g., larger-than-normal wall voltage, of keep-alive sites. Moreover, each site in the write column which was to remain OFF during "shift-in" (in FIG. 9, the sites in rows R2, R8, R10 and R12) would have to receive an appropriate cancelling signal on its row conductor to preclude shifting in of the ON state of the adjacent keep-alive site.

The timing charts of FIGS. 22 and 23 show the sequence of pulses applied to column conductors C1-C512 for lateral and upward shifting. The pulse sequence applied to conductor A2 is unique to that conductor. Of the remaining conductors, every fourth one receives the same pulses. Thus, as indicated in FIG. 1, column conductors C1-C512 are conveniently regarded as being arranged in four interleaved groups. Conductors C1, C5, etc., are designated as group $\phi_1$V. Conductors C2, C6, etc., are designated as group $\phi_2$V. Conductors C3, C7, etc., are designated as group $\phi_3$V. Conductors C4, C8, etc., are designated as group $\phi_4$V. Each horizontal line entry of the timing chart (FIGS. 22 and 23) represents the pulses applied to the various conductor groups during each of eight successive shifting intervals a through h. By shifting interval is meant the time period during which the states of one or the other sets of display sites (even or odd) are shifted to their respective transfer sites—corresponding to one step in the above-described two-step shifting process. (Although pulse CW is shown as being applied to conductor A2 during intervals b and e, it is, in reality, applied to conductor A2 one sustain cycle after the other conductors receive their respective pulses during those intervals.)

The conductors in groups $\phi_1$V, $\phi_2$V, $\phi_3$V and $\phi_4$V are assumed to initially correspond to the odd display, odd transfer, even display and even transfer displayed image columns, respectively. After the elapse of two shifting intervals, the display sites are now on the adjacent transfer sites and the transfer sites become the new display sites. Thus, the $\phi_2$V, $\phi_3$V, $\phi_4$V and $\phi_1$V conductors are the ones which correspond to the odd display, odd transfer, even display and even transfer display image columns, respectively. Since the conductors of each group must successively correspond to each of the four types of displayed image columns, the pattern of pulses applied to each conductor group repeats after four complete one-column-to-the-left shifts, i.e., eight shifting intervals.

The timing charts of FIGS. 22 and 23 also show the sequence of pulses applied to row conductors R1-R511 and to row conductors SR1-SR12. Every fourth one of these row conductors receives the same pulse. Thus, row conductors R1, R5, etc. belong to group $\phi$1R. Row conductors R2, R6, etc., belong to group $\phi$2R. Row conductors R3, R7, etc., belong to group $\phi$3R. Row conductors R4, R8, etc., belong to group $\phi$4R. In the staging area of the panel, for the reasons which will be discussed in more detail hereinafter, this pattern is modified. Row conductors SR1, SR5, SR9 and SR13 are in group $\phi$1R, while row conductors SR3, SR7, and SR11 are in group $\phi$3R. Row conductors SR2, SR6, SR10 and SR14 are controlled either by group $\phi$2R or by driver decoder 102 operating from data from data buffer 101. Row conductors SR4, SR8, and SR12 are controlled either by group $\phi$4R or by driver decoder 103 operating from data from data buffer 101.

Figure 7:
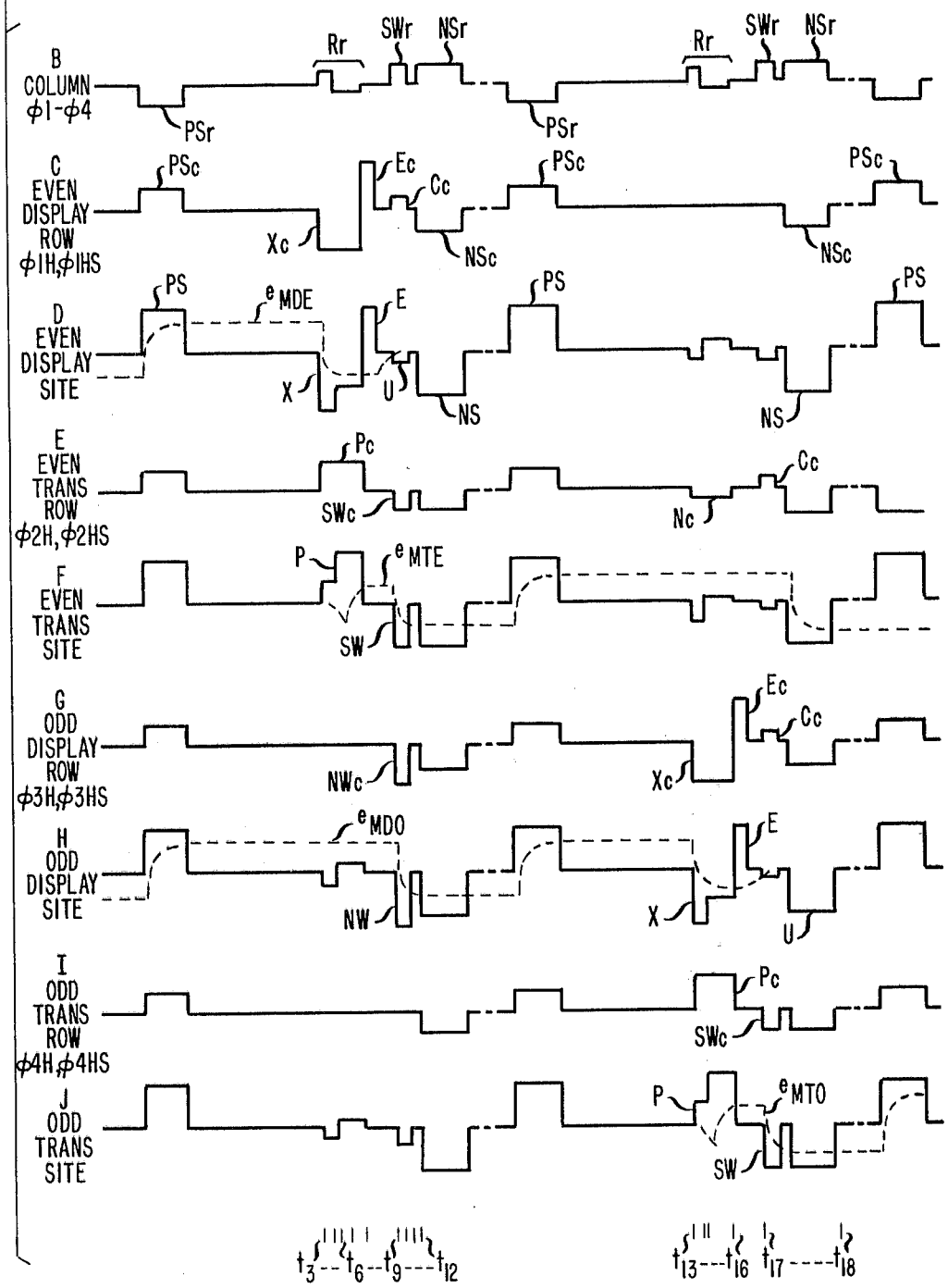
Figure 8:
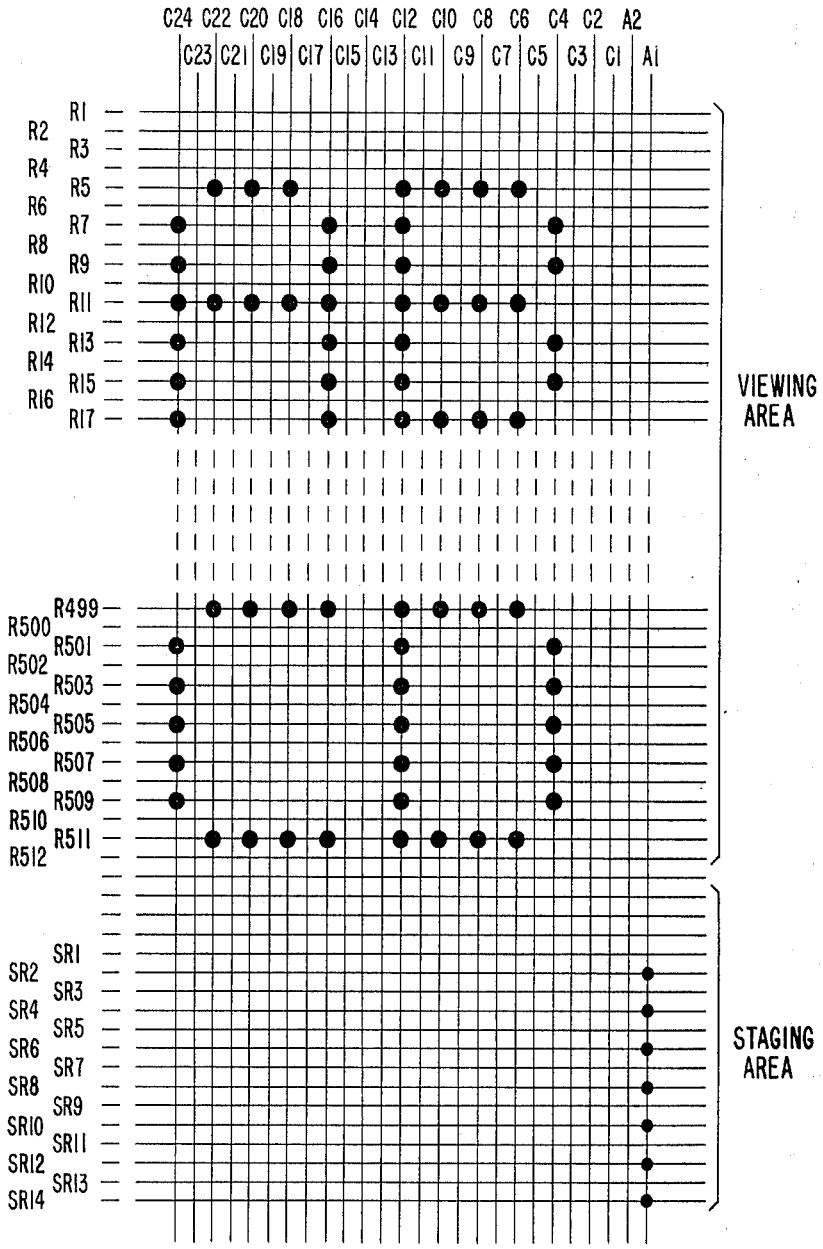
FIGS. 8–17 depict a site state shifting sequence helpful in explaining the principles of the invention.
Figure 9:
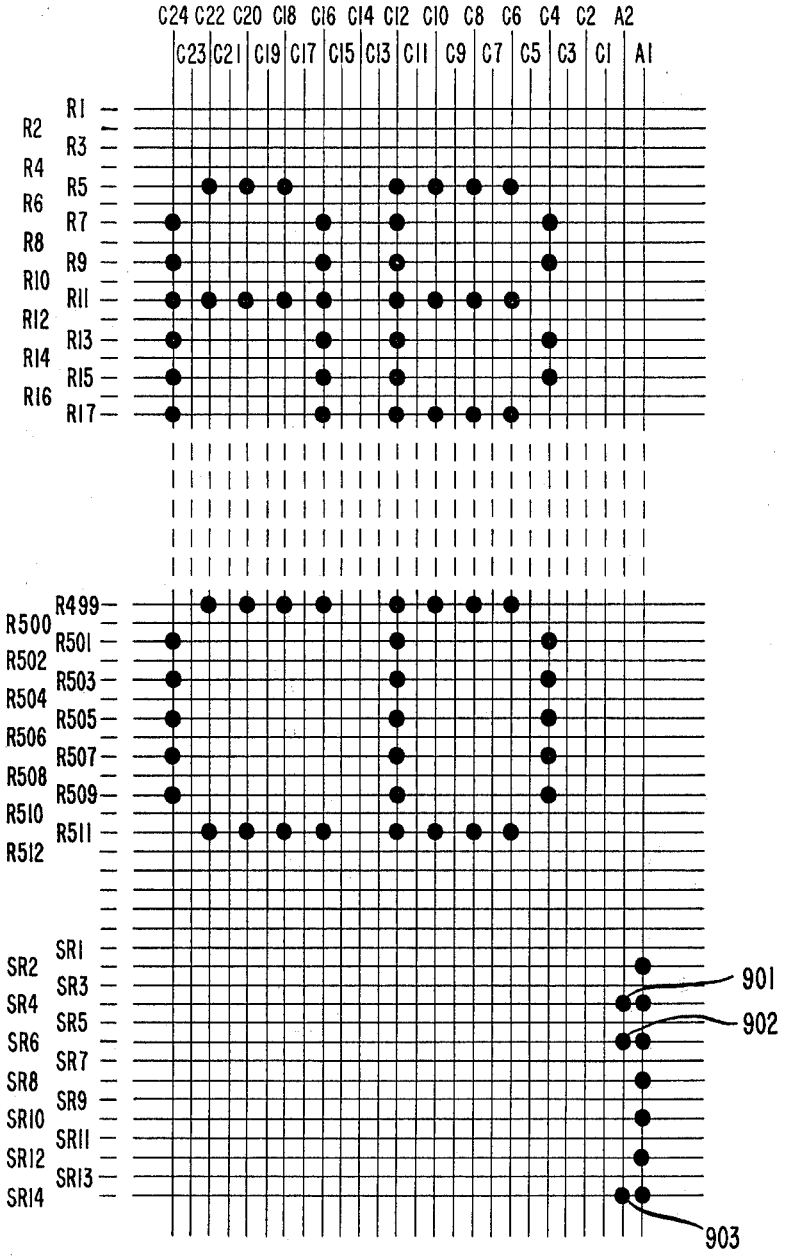
Figure 10:
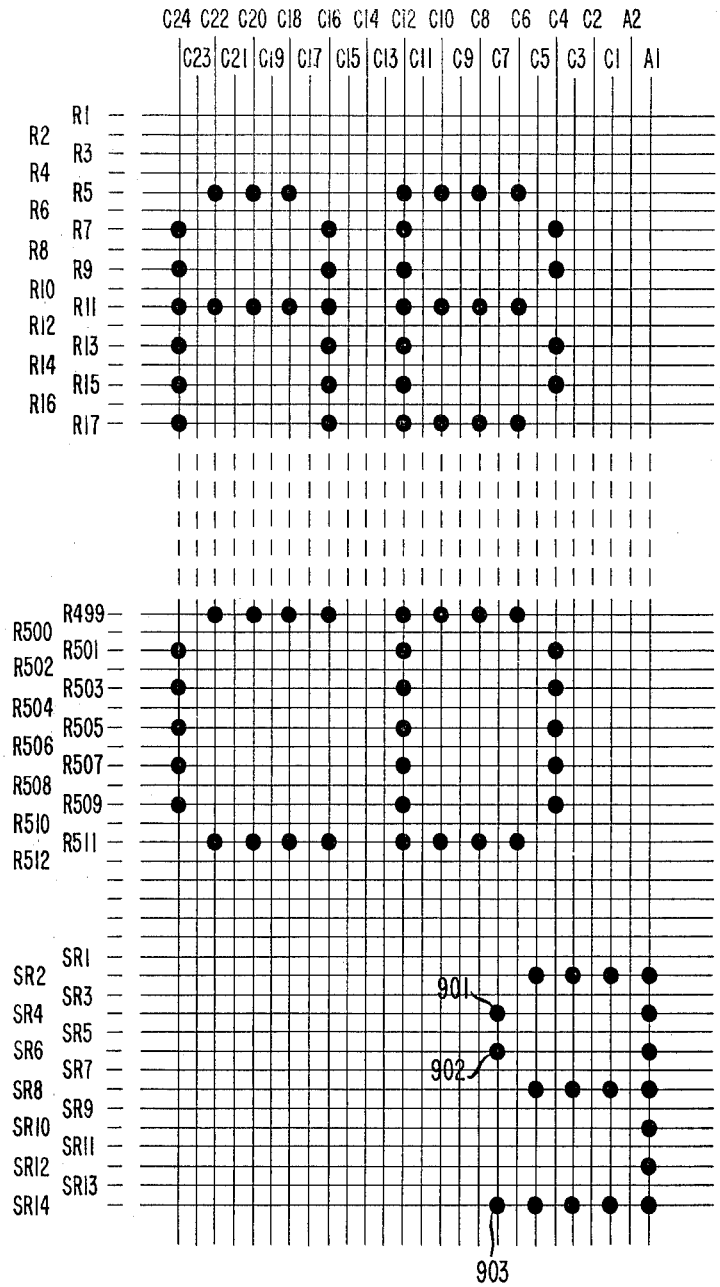
Figure 11:
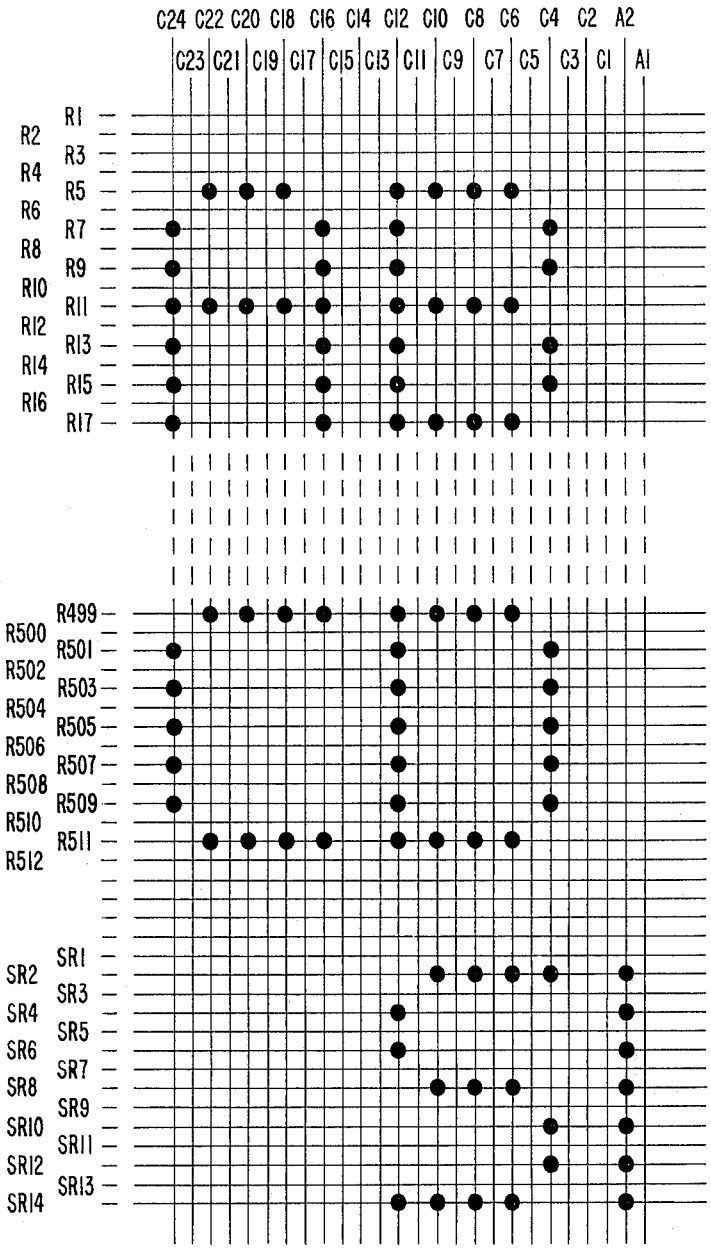
Figure 15:
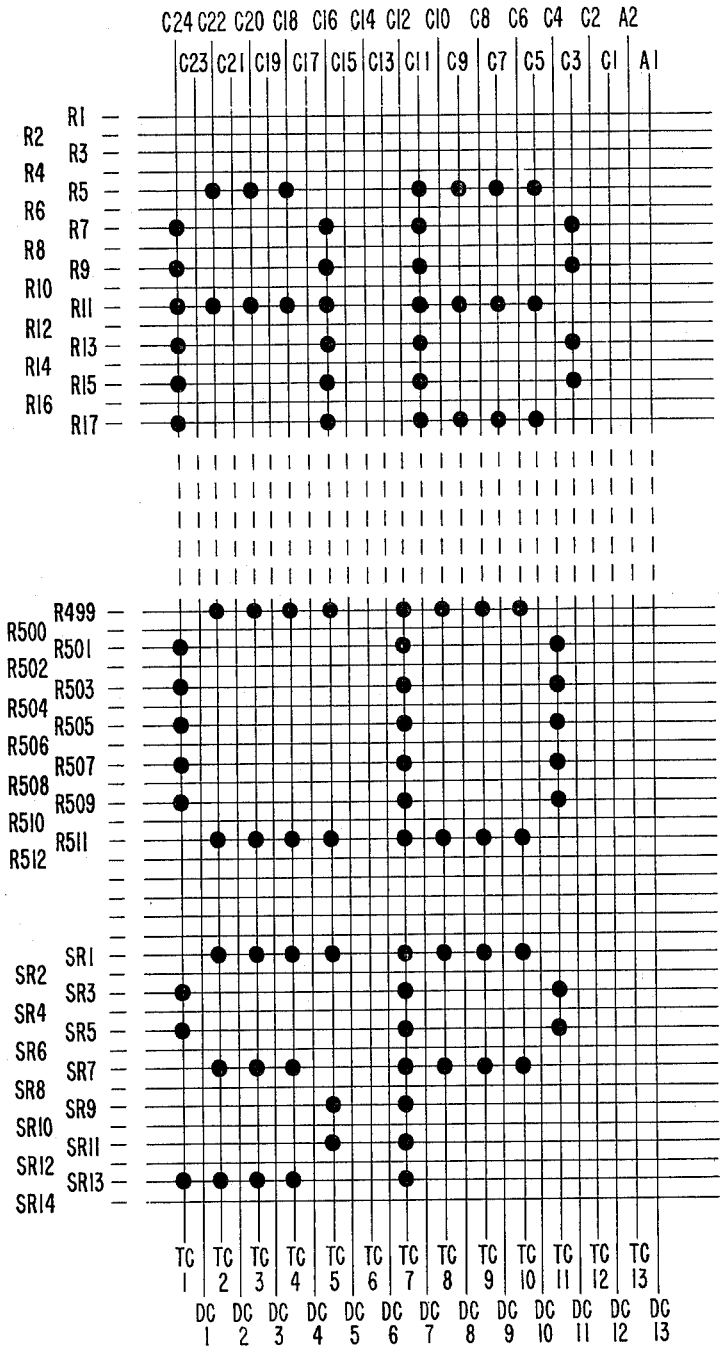
Figure 16:
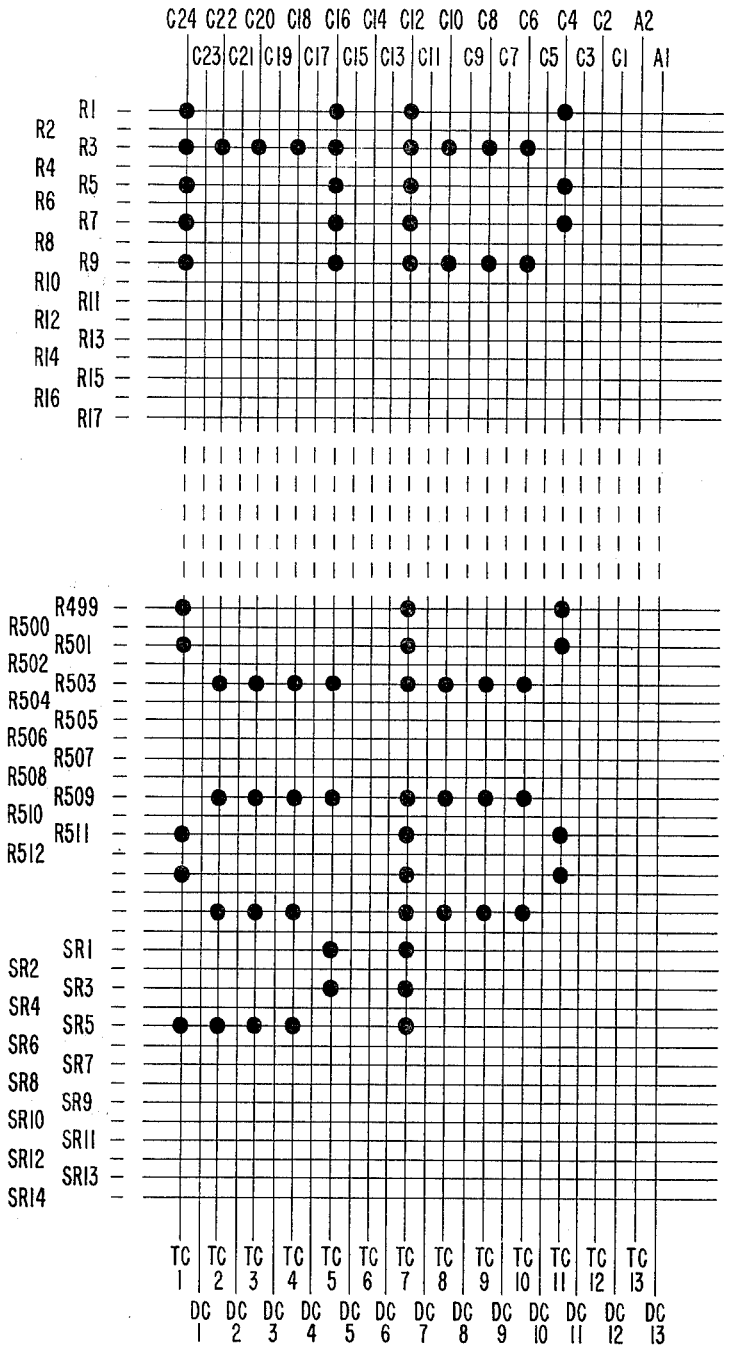
Figure 17:
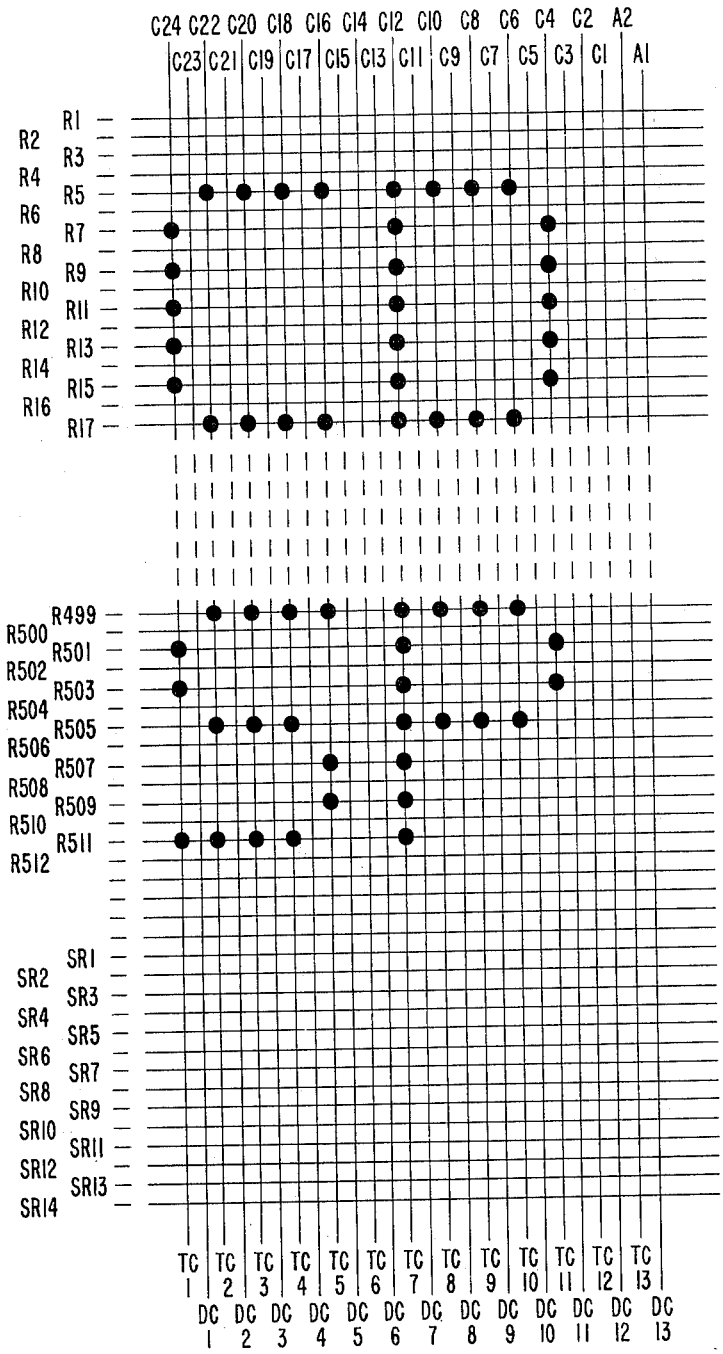

FIGS. 9–14 illustrate the creation of an "S" followed by the creation of a "P" with both being laterally shifted to the left and positioned directly under the priorly provided "A", "B", "C" and "D". It should, of course, be understood that such an alignment is not necessary and the information provided to the staging area can be shifted to any position within the staging area. Once positioned where desired, the ON sites are then shifted upward, as illustrated in FIGS. 15–17. This upward shifting is accomplished by using the four phase technique discussed previously with the difference being that the row conductors are used for the transporting pulses in sequencial fashion. The sequence of pulses for this operation is shown in FIG. 23, and the waveforms are shown in FIG. 7.

A review of FIGS. 14 and 15 will show that for one phase the staging area ON sites move upward from the even rows to the odd rows while the viewing area ON sites remain constant. On subsequent phases, as shown in FIGS. 15–17, all of the ON sites in both the staging and viewing areas move upward together. The purpose of this operation (which will be discussed hereinafter) is a result of one embodiment where advantage is taken of the alternate nature of the display patterns. At this point, it only need be noted that prior to upward shifting the ON-SITES in the staging area are on the even rows, while the ON-SITES in the viewing area are on the odd rows.

More particular reference is now made to the display system of FIG. 1. In addition to display panel 100, the system includes timing circuit 111, data buffer 101, row and column sustain drivers RSD and CSD, respectively, upward shift row drivers $\phi$1H-$\phi$4H, column A2 driver A2D, keep-alive driver KAD, column shift drivers $\phi$1V-$\phi$4V, and steering diode, i.e., OR gates SD. The above-mentioned drivers may all be similar to the type disclosed, for example, in U.S. Pat. No. 3,754,230 issued Aug. 21, 1973, to E. P. Auger. Data buffer DB may be similar to that shown, for example, in FIGS. 9-10 of U.S. Pat. No. 3,292,156, issued Dec. 13, 1966, to N. H. Stockel. Timing circuit 111 may be of the general type disclosed in my U.S. Pat. No. 4,104,626 issued Aug. 1, 1978.

The output signals of timing circuit 111 are described in my aforementioned copending patent application and will not be repeated herein except as is necessary for an understanding of the distinctions between my inventions.

Beginning with column C1, every fourth column of panel 100 receives the same pulse sequence, as previously indicated. In particular, timing circuit 111 generates logic level signals within cable $\phi$1T, which define the times during each block of eight shifting intervals when pulses Cc and Nc and the column components of pulses X, E, P, SW and NW are to be applied to column conductors C1, C5, etc., by way of the associated one of gates SD. Conductors C2, C6, etc., similarly receive the output of driver $\phi$2V, while conductors C3, C7, etc., receive the output of driver $\phi$3V and conductors C4, C8, etc., receive the output of driver $\phi$4V. The signals received, and the pulses generated, by drivers $\phi$2V, $\phi$3V and $\phi$4V are the same as those of driver $\phi$1V, but are delayed two shifting intervals with respect to the previous one. To achieve this, appropriate timing signals for pulses Cc and Nc and for the column components of pulses X, E, P, SW and NW are provided to driver $\phi$2V via cable $\phi$2T.

In a similar manner, conductor A2 receives pulse Cc and the column components of pulses CW, X and E from driver A2D. The latter, in turn, is responsive to logic level signals via cable A2T.

The odd-numbered row conductors R1, R5, etc., receive row components Rr and SWr from row drivers $\phi$1H while row conductors R3, R7, etc., receive row components Rr and SWr from row drivers $\phi$3H. Drivers $\phi$1H and $\phi$3H generate those components in response to logic level signals on cables $\phi$1TH and $\phi$3TH. The timing signals on these cables define the time slots for the positive and negative portions of row component Rr. The timing signals also define the time slot for the row component of pulse SW (and thus of pulse NW).

A tap off lead CW0 of cable C2T is explicitly shown in FIG. 1. This lead carries a signal during the time slot in which conventional write pulse CW is to be applied to the desired sites in the column defined by conductor A2. Lead CW0 extends to data buffer 101 which has a plurality of logic level output leads 109 and 110. The output of data buffer 101 are connected to driver decoders 102 and 103. Driver decoders 102 and 103 act as row drivers providing isolation between the rows while also allowing the associated rows to be controlled by a single signal. For example, a signal applied on input lead $\phi$2R would be applied to all row conductors SR2, SR6, SR10, and SR14, while inputs from cable 109 are only applied to the appropriate row conductor defined by the input signal.

Data buffer 101 responds to the signal on lead CW0 by providing logic level "1"s on individual ones of its output leads in accordance with the OFF and ON pattern to be presented in the write column, i.e., the column defined by conductor A2. The driver decoder, in response to receipt of a "1" extends the row half-select component CWr of pulse CW, to the proper row conductor. Since only column A2 receives the column half-select component CWc, the only sites affected by the row half-select component CWr are those sites in the write column which are to be switched ON.

Circuit 111 continuously provides the above-described timing signals on cable SUS during non-shifting periods to continuously generate the sustain signal necessary to maintain whatever sites are currently in the ON state in that state. At the same time, data buffer 101 receives, over lead 260, new information to be shifted onto the panel. Lead 260 may extend from a digital computer, for example, or other data processor.

When shifting is to commence, buffer 101 provides a logic level "1" to timing circuit 111 over lead 261. The latter, in response, begins to generate the sequence of logic level signals necessary to generate the pulse sequence of FIG. 22. Whenever the buffer is empty, the signal on lead 261 returns to "0". Circuit 111 continues in the shifting mode through the next-occurring one of shifting intervals d or h and then returns to the pure sustain mode. Then information stored in the staging area of panel 100 will be sustained until removed.

Upward shifting of the information stored in the staging area of panel 100 can begin automatically at the conclusion of the shifting interval under control of timing circuit 111 or it may advantageously move upward under control of information supplied via data buffer 101 via lead 262. This information could be a simple command to move the display upward a fixed amount or the information can specify how many phases upward the visual image is to be moved.

From an understanding of the foregoing it will be understood that two diverse criteria must be met for proper lateral and upward shifting. For upward shifting it is necessary that every fourth conductor be connected together since the phases are continuously repeating. In the viewing section of the panel this presents no difficulty. However, in the staging area the individual rows must be isolated so that ON sites may be created on any row. Thus, if each fourth row were to be electrically connected (as is necessary for upward transportation), then an attempt to turn an ON site on (for example, row SR2) would result in ON sites in rows SR6, SR10 and SR14. This problem is overcome, in one embodiment, by floating the ON-site generation signals on top of the phasing signals by using driver decoders 102 and 103 which advantageously can be Texas Instrument decoder number SN75501A.

I have further recognized that the number of drivers and supporting control circuitry can be greatly reduced by taking advantage of the fact that ON sites are, for good visual presentation, generated on alternate rows and alternate columns. Thus, as seen from FIG. 14, the letters in the upper or visual area of the panel are displayed on odd rows while the information contained in the lower or staging area is on even rows. Using this technique the blanking pulse which is applied to prevent lateral transportation of the viewing area ON sites need only be applied to the odd rows of the viewing area. Thus, only cables $\phi$1TH and $\phi$3TH must contain these pulses which, as shown in FIG. 1, are extended to every fourth row conductor of panel 100, including the odd row staging area conductors SR1, SR5, SR7, SR9, SR11, and SR13 of the staging area. Since ON sites, by design, are not placed on the odd rows of the staging area, the fact that those rows contain the blanking pulse is of no concern.

By way of the same convention, since the viewing area ON sites can only be on the odd rows, there is no need to provide the blanking pulse on the even rows and thus cables $\phi$2TH and $\phi$4TH do not contain the blanking pulse. Thus, those cable signals can be extended to the rows of the staging area if adequate provision is made for isolation as priorly discussed.

For upward shifting, since the staging area ON sites are on the even rows and the viewing area ON sites are on the odd rows, it is important to start the sequence at interval c (FIG. 22) which, at the end of interval d, serves to move the staging area information upward one row, i.e., to even rows as they are in the viewing area. During this interval the viewing area information is held stationary. Beginning with interval e, all of the display information (staging area and viewing area) is moved upward. This is shown in FIG. 15.

On subsequent phases all of the information, both from the upper and lower areas move concurrently as shown in FIGS. 16 and 17. Of course, if it is desired to move the entire array of ON sites laterally, this can be accomplished simply by removing the blanking pulse from cables $\phi$1TH and $\phi$3TH.

It will thus be appreciated that the specific embodiment of the invention shown and described herein is merely illustrative. Those skilled in the art will be able to devise many and varied arrangements embodying the principles of the invention without departing from the spirit and scope thereof. For example, other staging areas can be arranged, either out of the visual area, or within this visual area, and images could be formed or stored, in many locations, even between the lines of the viewing area.

What is claimed is:

1. Circuitry for use in an ac plasma panel display system, said circuitry comprising first means for inhibiting charge cloud transportation at selected ON sites within said panel while still allowing said transportation between other of said sites, said first means including means for prematurely activating said charge cloud at said selected ON sites.

2. The invention set forth in claim 1 wherein said first means includes the application of an excitation pulse to selected ON sites followed by the application of a priming pulse to next adjacent sites, and wherein said inhibiting means includes means for applying a blanking pulse to said selected ON sites prior to said application of said excitation pulse.

3. Circuitry for use in a display system which includes at least first and second adjacent ac gas discharge sites, said circuitry comprising first means for impressing an excitation pulse across said first site, said excitation pulse being such as to create a charge cloud in the vicinity of said first site only if it is in the ON state, second means for impressing a priming pulse across said second site when said excitation pulse is impressed across said first site, said excitation and priming pulses being such that charge carriers from said charge cloud are transported to the vicinity of said second site and characterized by third means for impressing an inhibiting pulse across said first site, said inhibiting pulse being applied prior to said excitation pulse to create a premature charge cloud in the vicinity of said first site if said first site is in the ON state.

4. The invention set forth in claim 3 wherein said inhibiting pulse is applied approximately microseconds before said priming pulse.

5. An ac plasma panel having at least first and second adjacent ac gas discharge sites, said panel comprising first means for impressing an excitation pulse across said first site, said excitation pulse being such as to create a charge cloud in the vicinity of said first site only if it is in the ON state, second means for impressing a priming pulse across said second site when said excitation pulse is impressed across said first site, said excitation and priming pulses being such that charge carriers from said charge cloud are transported to the vicinity of said second site and characterized by third means for impressing an inhibiting pulse across said first site, said inhibiting pulse being applied prior to said excitation pulse to create a premature charge cloud in the vicinity of said first site if said first site is in the ON state.

6. Circuitry for use in conjunction with an ac plasma panel having gas discharge sites disbursed in intersecting rows and columns and wherein said panel forms at least one viewing area and at least one staging area, said circuitry comprising first means for transporting ON-site discharges laterally on said panel using a technique wherein an excitation pulse is impressed across all the sites of a given column creating a charge cloud in the vicinity of the ON sites defined by said column and wherein a priming pulse is impressed across an adjacent column, said pulses being such that charge carriers are transported from said ON sites of said given column to a newly formed ON site at said adjacent column, and second means for creating a blanking pulse at selected sites to prevent said charge carrier transportation to said selected sites.

7. The invention set forth in claim 6 wherein said blanking pulse is applied via a row conductor intersecting said given column conductor.

8. The invention set forth in claim 6 wherein said blanking pulse is applied at least 1 microsecond prior to said excitation pulse.

9. The invention set forth in claim 8 further comprising third means for transporting ON-site discharges vertically on said panel using a technique wherein an excitation pulse is impressed across all the sites of a given row creating a charge cloud in the vicinity of the ON sites defined by said row and wherein a priming pulse is impressed across an adjacent row, said pulses being such that charge carriers are transported from the ON sites of said given row to a newly formed ON site of said adjacent row.

10. The invention set forth in claim 9 wherein said first means includes fourth means for connecting together each fourth column conductor and for applying phased pulses concurrently to each set of grouped conductors, and wherein said third means includes fifth means for connecting together each fourth row conductor and for applying phased pulses concurrently to each set of grouped conductors, said fifth means including sixth means for isolating from each other alternate rows of said staging area.

11. The invention set forth in claim 6 wherein said blanking pulse is of a voltage polarity to reverse the charge carriers across said viewing area ON sites.

12. The invention set forth in claim 6 further comprising means for establishing within said staging area selective patterns of ON sites.

13. The invention set forth in claim 6 further comprising means for establishing within said staging area selective patterns of ON sites.

14. The invention set forth in claim 13 wherein said selective pattern of ON sites is established at the sites formed on said alternate rows of said staging area.

15. The invention set forth in claim 14 wherein said alternate rows of said staging area are the even rows and wherein said third means is operative to vertically transport established even row staging area ON sites to odd rows within said viewing area.

16. The method of establishing visual patterns on an ac plasma panel comprising the steps of establishing on said panel a viewing area and a staging area, establishing within said staging area a desired image of ON sites, said image being formed column by column, laterally transporting by charge cloud migration established columns of ON sites across said panel within said staging area while holding ON sites within said viewing area in a fixed position with respect to said viewing area, said laterally transporting step including the step of prematurely creating a charge cloud migration of electrons at said ON sites within said viewing area and upward transporting said lateral shifted ON sites to replace certain ones of said ON sites of said viewing area.

* * * * *